United States Patent [19]

Cheskis et al.

[11] 4,071,359

[45] Jan. 31, 1978

[54] COPPER BASE ALLOYS

[75] Inventors: Harvey P. Cheskis; Stanley Shapiro, both of New Haven; Jacob Crane, Woodbridge, all of Conn.

[73] Assignee: Olin Corporation, New Haven, Conn.

[21] Appl. No.: 672,130

[22] Filed: Mar. 31, 1976

[51] Int. Cl.[2] ..... C22C 9/01

[52] U.S. Cl. ..... 75/160; 75/153; 75/157.5; 75/162

[58] Field of Search ..... 75/153, 160, 162, 157.5; 148/11.5 C, 32, 160

[56] References Cited

U.S. PATENT DOCUMENTS

| | | | |
|---|---|---|---|
| 1,714,729 | 5/1929 | Read | 75/162 |
| 2,270,716 | 1/1942 | Morris | 75/160 |
| 2,357,190 | 8/1944 | Evans | 75/159 |
| 2,802,733 | 8/1957 | Bungardt | 75/162 X |
| 3,475,227 | 10/1969 | Caule et al. | 148/11.5 C |
| 3,694,273 | 9/1972 | Crane et al. | 75/162 |

FOREIGN PATENT DOCUMENTS

| | | | |
|---|---|---|---|
| 192,124 | 9/1957 | Austria | 75/153 |

*Primary Examiner*—C. Lovell

*Attorney, Agent, or Firm*—Robert H. Bachman; Robert A. Dawson

[57] ABSTRACT

Copper base alloys having improved rupture properties and improved hot rolling performance consisting of from 2 to 9.5% aluminum, preferably also from 0.001 to 3.0% silicon, a grain refining element, preferably cobalt in an amount from 0.001 to 5.0%, from 0.001 to 0.5% of a material selected from the group consisting of a material of the lanthanide series of the Periodic Table and mixtures thereof, and the balance essentially copper.

10 Claims, No Drawings

COPPER BASE ALLOYS

BACKGROUND OF THE INVENTION

The present invention relates to the series of copper base alloys containing aluminum, and preferably also silicon, plus one or more grain refining elements. It is common practice to add grain refiners to various solid solution, single phase alloys for the purpose of maintaining a fine grain material during processing from the original cast material to the final wrought product. The grain refiner may be added to improve processing and/or to improve properties. In most cases a grain refiner serves to maintain uniform properties over a compositional range and over a range of processing conditions.

Alloys of the foregoing type are, however, often prone to rapid grain boundary failure under stress over the temperature range of from 450° to 950° C. During casting and subsequent direct chill solidification of these alloys, residual stresses may result which subsequently lead to grain boundary sliding, void formation and grain boundary damage when the alloy is heated for hot rolling, as, for example, in the range 870° to 900° C. The defective grain boundaries and low strength of the grain boundaries often result in cracking during hot rolling. This cracking results in significant material losses when the alloy is subsequently processed into a strip product.

It is, therefore, a principal object of the present invention to provide an improved copper base alloy characterized by good hot rollability and good properties.

It is a further object of the present invention to provide an improved, grain refined copper base alloy containing aluminum which is not prone to rapid grain boundary failure under stress at elevated temperatures.

It is a still further object of the present invention to provide an improved copper base alloy as aforesaid which is particularly suitable for processing into wrought products, such as strip, without significant material losses.

Further objects and advantages of the present invention will appear hereinbelow.

SUMMARY OF THE INVENTION

In accordance with the present invention it has now been found that the foregoing objects and advantages may be readily obtained. The alloy of the present invention consists essentially of from 2 to 9.5% aluminum, from 0.001 to 0.5% of a material selected from the group consisting of a material of the lanthanide series of the Periodic Table and mixtures thereof, preferably mischmetal or cerium, a grain refining element selected from the group consisting of iron from 0.001 to 5.0%, chromium from 0.001 to 1.0%, zirconium from 0.001 to 1.0%, cobalt from 0.001 to 5.0% and mixtures of these elements, preferably cobalt, and the balance essentially copper. In addition, it is preferred that the alloy include from 0.001 to 3.0% silicon.

Throughout the present specification, all percentages are weight percentages.

The foregoing alloy is particularly suitable as a wrought product, has improved high temperature rupture properties and does not yield significant material losses when processed into strip. Furthermore, it has been found that the addition of the lanthanide element overcomes the difficulty of the aforesaid alloy with respect to grain boundary failure under stress at elevated temperatures.

DETAILED DESCRIPTION

The copper base alloy of the present invention contains aluminum in an amount from about 2 to 9.5%, and preferably from about 2 to 5%. Silicon is a particularly preferred additive in an amount from about 0.001 to 3%, and preferably from about 1 to 3%. Generally, the alloys of the present invention should contain less than about 1% zinc.

In addition, as indicated hereinabove, the alloy of the present invention contains one or more grain refining elements selected from the group consisting of iron from about 0.001 to 5.0%, preferably from about 0.1 to 2.0%, chromium from about 0.001 to 1.0%, preferably from about 0.1 to 0.8%, zirconium from about 0.001 to 1.0%, preferably from about 0.1 to 0.8%, cobalt from about 0.001 to 5.0% and preferably from about 0.1 to 2.0%, and mixtures thereof. The preferred grain refining element is cobalt.

In addition, as indicated hereinabove, the alloy of the present invention contains from about 0.001 to 0.5%, and preferably from about 0.03 to 0.3%, of a material selected from the group consisting of the elements of the lanthanide series of the Periodic Table and mixtures thereof. Preferably, one uses mischmetal or cerium as the lanthanide component. The term mischmetal describes a material composed largely of the lanthanides comprising elements No. 58–71 of the Periodic Table. A typical mischmetal composition is listed below.

| | | |
|---|---|---|
| Cerium | - | 50% |
| Lanthanum | - | 27% |
| Neodymium | - | 16% |
| Praseodymium | - | 5% |
| Other Rare Earth Metals | - | 2% |

However, as used in this application the term mischmetal is intended to include any material comprised predominately of a metal of the lanthanide series regardless of the relative proportions thereof. For example, as indicated above, cerium alone can readily be used in place of mischmetal and would provide equally satisfactory results.

It has been found that the alloy of the present invention is particularly applicable to CDA Alloy 638 which contains from about 2.5 to 3.1% aluminum, from about 1.5 to 2.1% silicon, from about 0.25 to 0.55% cobalt and the balance copper.

The balance of the alloy of the present invention is essentially copper. Naturally, the alloy of the present invention may contain impurities common for alloys of this type. Also, additional additives may be employed in the alloy of the present invention, if desired, in order to emphasize particular characteristics or to obtain particularly desirable results.

It is a feature of the present invention that the present alloys may be readily processed into desirable wrought products. Thus, the alloy may be cast by conventional methods, with the lanthanide addition made to the molten metal prior to casting, and processed in accordance with conventional processing to provide a wrought product, such as strip material. For example, the alloy may be heated to hot rolling temperature, hot rolled at an elevated temperature, cold rolled and annealed, with one or more cycles of cold rolling and annealing, if desired, to provide a strip product either in the annealed condition or in the temper rolled condition.

In accordance with the present invention it has been found that a significant and surprising improvement is obtained in the high temperature rupture response of the cast alloy, thereby improving the hot rolling performance of the alloy. The resultant strip product is characterized by no significant material losses and the lanthanide addition significantly overcomes the heretofore rapid grain boundary failure under stress at an elevated temperature.

The present invention will be more readily understandable from a consideration of the following illustrative example.

EXAMPLE

Three alloys of differing compositions were prepared by vacuum induction melting and vacuum chill casting in 2 × 2 × 4 inch molds. Alloy 1 had a composition of 2.8% aluminum, 1.8% silicon, 0.4% cobalt, and the balance copper. Alloy 2 had the same composition as Alloy 1, except that 0.03% mischmetal was added to the molten metal prior to chill casting. Alloy 3 had the same composition as Alloy 1, except that 0.19% mischmetal was added to the molten metal prior to chill casting. Tensile samples of each alloy ½ inch in diameter were machined and tested at various temperatures and stresses in a stress-rupture test. Rupture lives were measured for each alloy in a standard creep-rupture test in which the alloy sample is heated to the desired temperature, a stress is applied, and the time to rupture of the sample is measured. The following table indicates the temperatures, stress and resulting rupture lives for the three alloys and clearly illustrates the significant improvement in high temperature rupture response which characterizes the alloys of the present invention.

HIGH TEMPERATURE RUPTURE RESPONSE

| Alloy | Test Temperature, ° C. | Stress, psi | Time to Failure, hrs. |
|---|---|---|---|
| 1 | 650 | 3500 | 4.5 |
| 2 | 650 | 3500 | 80.0 |
| 3 | 650 | 3500 | 85.5 |
| 1 | 850 | 1000 | 13.8 |
| 2 | 850 | 1000 | 160.0 |
| 3 | 850 | 1000 | 96.4 |

This invention may be embodied in other forms or carried out in other ways without departing from the spirit or essential characteristics thereof. The present embodiment is therefore to be considered as in all respects illustrative and not restrictive, the scope of the invention being indicated by the appended claims, and all changes which come within the meaning and range of equivalency are intended to be embraced therein.

What is claimed is:

1. A copper base alloy having improved high temperature rupture properties consisting of from 2 to 9.5% aluminum, a grain refining element selected from the group consisting of iron from 0.001 to 5.0%, chromium from 0.001 to 1%, zirconium from 0.001 to 1.0%, cobalt from 0.001 to 5.0%, and mixtures of these elements, from 0.01 to 0.5% of a material selected from the group consisting of a material of the lanthanide series of the Periodic Table and mixtures thereof, balance copper.

2. An alloy according to claim 1 further including from 0.001 to 3% silicon.

3. An alloy according to claim 1 wherein the aluminum content is from 2 to 5%.

4. An alloy according to claim 1 containing 2.5 to 3.1% aluminum, 1.5 to 2.1% silicon, 0.25 to 0.55% cobalt, from 0.001 to 0.5% of a material selected from the group consisting of a material of the lanthanide series of the Periodic Table and mixtures thereof, and the balance copper.

5. An alloy according to claim 1 wherein said lanthanide material is mischmetal.

6. An alloy according to claim 1 wherein said lanthanide is cerium.

7. An alloy according to claim 1 wherein said grain refining element is cobalt.

8. An alloy according to claim 1 containing less than 1% zinc.

9. An alloy according to claim 1 containing from 0.03 to 0.3% of said lanthanide material.

10. A copper base alloy having improved high temperature rupture properties consisting of from 2 to 9.5% aluminum, from 0.001 to 3% silicon, less than 1% zinc, a grain refining element selected from the group consisting of iron from 0.001 to 5.0%, chromium from 0.001 to 1%, zirconium from 0.001 to 1%, cobalt from 0.001 to 5.0%, and mixtures of these elements, from 0.001 to 0.5% of a material selected from the group consisting of a material of the lanthanide series of the Periodic Table and mixtures thereof, balance copper.

* * * * *